US008777304B2

(12) United States Patent
Dixon

(10) Patent No.: US 8,777,304 B2
(45) Date of Patent: Jul. 15, 2014

(54) FURNITURE CONVERTIBLE TO PLAY SPACE

(76) Inventor: William Morgan Dixon, New York, NY (US)

( * ) Notice: Subject to any disclaimer, the term of this patent is extended or adjusted under 35 U.S.C. 154(b) by 548 days.

(21) Appl. No.: 13/016,815

(22) Filed: Jan. 28, 2011

(65) Prior Publication Data

US 2011/0266846 A1 Nov. 3, 2011

Related U.S. Application Data

(60) Provisional application No. 61/329,559, filed on Apr. 29, 2010, provisional application No. 61/384,759, filed on Sep. 21, 2010.

(51) Int. Cl.
*A47C 13/00* (2006.01)
*A47D 11/00* (2006.01)

(52) U.S. Cl.
CPC ..... *A47D 11/005* (2013.01)
USPC ..... 297/118; 297/1

(58) Field of Classification Search
USPC ..... 297/118, 129, 1, 2, 3, 181, 440.1, 297/463.2; 446/476, 478, 479, 482
See application file for complete search history.

(56) References Cited

U.S. PATENT DOCUMENTS

| | | | | | |
|---|---|---|---|---|---|
| 992,337 | A * | 5/1911 | Butler | 446/75 |
| 2,891,255 | A * | 6/1959 | Simmons | 5/9.1 |
| 3,236,003 | A * | 2/1966 | Flood, Jr. | 446/110 |
| 3,916,460 | A * | 11/1975 | Harty | 5/13 |
| 4,244,619 | A * | 1/1981 | Yoshimura | 297/34 |
| 4,637,081 | A * | 1/1987 | Clark | 5/18.1 |
| 5,085,608 | A * | 2/1992 | Turner | 446/75 |
| 5,330,379 | A * | 7/1994 | Roh et al. | 446/71 |
| 6,848,127 | B2 * | 2/2005 | Inagaki | 5/18.1 |
| 7,523,989 | B2 * | 4/2009 | Wieland et al. | 297/440.13 |
| 2006/0135032 | A1 * | 6/2006 | Wijerama | 446/108 |
| 2012/0015582 | A1 * | 1/2012 | Van Tilburg | 446/110 |
| 2012/0304389 | A1 * | 12/2012 | Ranck et al. | 5/655.9 |

* cited by examiner

*Primary Examiner* — David R Dunn
*Assistant Examiner* — Alexander Harrison
(74) *Attorney, Agent, or Firm* — Day Pitney LLP

(57) ABSTRACT

Transformable furniture is provided, which is a unitary structure which itself transforms between seating and a play space. More specifically, the furniture has first and second frame members which move towards each other to form a couch and away from each other to form a play space, such as a playhouse.

26 Claims, 18 Drawing Sheets

FURNITURE CONVERTIBLE TO PLAY SPACE

CONTINUITY

This application claims priority to Provisional U.S. Patent Application No. 61/329,559 filed on Apr. 29, 2010 and Provisional U.S. Patent Application No. 61/384,759 filed on Sep. 21, 2010, both on behalf of William Dixon, and both of which are incorporated herein by reference in their entirety.

BACKGROUND

1. Field of the Disclosed Embodiments

The disclosed embodiments related to toys for children and more specifically to furniture which converts to a play space.

2. Background of the Disclosed Embodiments

A child's play area is often equipped with a playhouse type structure which mimics the appearance of a real house, such as a gable style house. A static (non-foldable) playhouse for a child takes up significant space, while a foldable playhouse is often cumbersome and provided in an unattractive construction of wire and plastic. In addition, the folded playhouse requires storage space for the compacted structure, such as under a bed or in a closet, which displaces other items intended for temporary or permanent storage.

In addition, children often enjoy relaxing on a couch while reading or watching cartoons. In small locations, such as in smaller homes and in city apartments, it is difficult to have both a couch and a playhouse share a play space.

SUMMARY OF THE DISCLOSED EMBODIMENTS

A transformable couch is disclosed which is a children's couch that can be transformed into a playhouse. In an alternative embodiment, the playhouse can be further transformed into a castle. For children, it is a creative play space they can manipulate. For the parent with a small child's play area, the transformation of the house into a usable couch relieves the burden of having to displace items otherwise in storage around the living space.

DESCRIPTION OF THE FIGURES

Various embodiments disclosed herein are illustrated in the accompanying figures, which are not to be considered limiting and in which.

DETAILED DESCRIPTION OF THE EMBODIMENTS

Figure 1B:
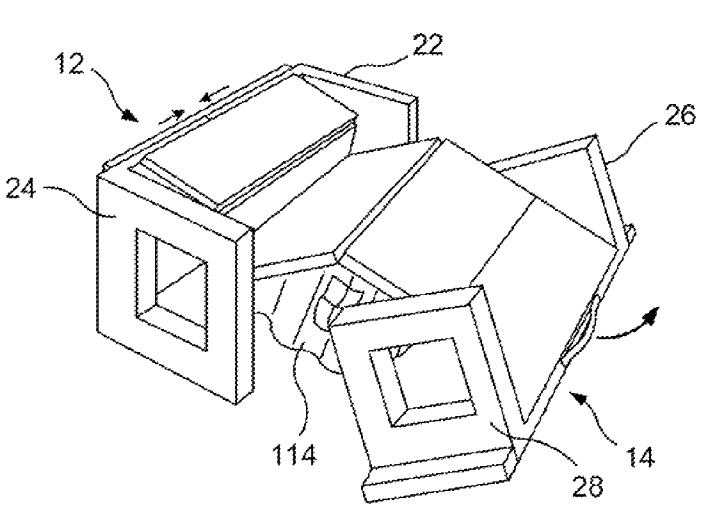
FIGS. 1B-1C are views of the convertible furniture being transformed into a house.

The transformable couch 10 is formed from foam and sewn fabric or any such material suitable for child safety. As illustrated, starting with FIG. 1, the basic construction utilizes first and second nestable and substantially similar squared-off U-shaped members 12, 14, one of which forms the back frame for the couch 10 and the other of which forms a base frame for the couch 10. A foldable cushion 16 is provided which has a first lengthwise end 18 connected to the back frame 12 and a second lengthwise end 20 connected to the couch base frame 14. As will be explained below, positioning the back frame 12 and base frame 14 against each other forms a couch 10, while separating the back frame and base frame from each other forms a play space 22, shaped as a gable roof house.

Figure 2:
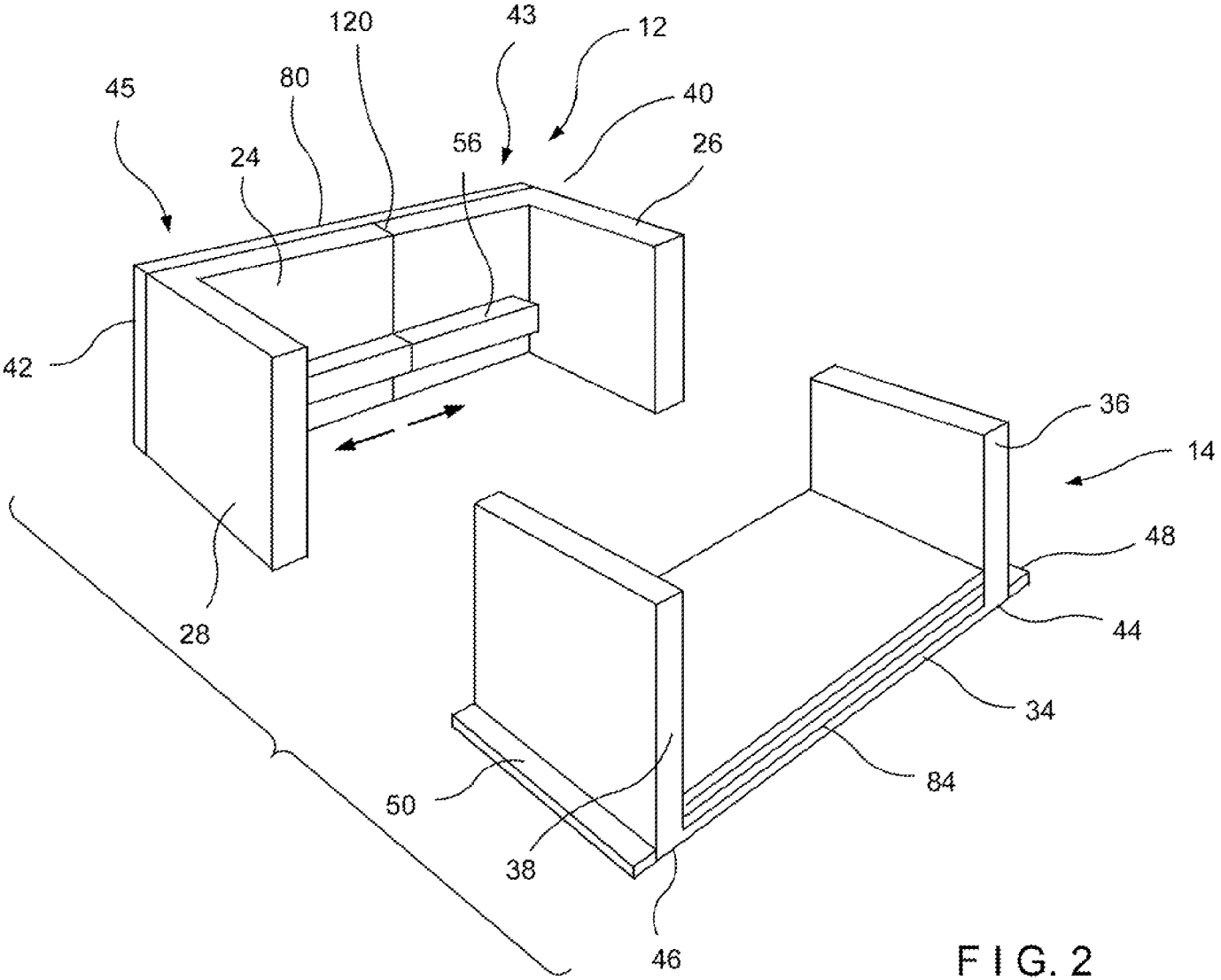
FIGS. 2, 3A and 3B illustrate the back and bottom frame members for the couch.

As illustrated in FIG. 2, the back frame 12 includes a substantially rectangular body panel 24, where the greater dimension extends in the widthwise direction for the couch 10. In addition, extending substantially perpendicular to the back body panel 24 is a first distal (e.g., left in the couch widthwise direction) armrest structure 26 and a first proximate (e.g., right in the couch widthwise direction) armrest structure 28. Similarly, the base frame 14 includes a substantially rectangular body panel 34, which is substantially the same shape as the back body panel 24 and where the greater dimension extends in the widthwise direction for the couch 10. Extending substantially perpendicular to the base body panel 34 is a second distal armrest structure 34 and a second proximate armrest structure 36. The distal and proximate armrest structures are substantially square and when the couch is assembled, form distal and proximate armrests 30, 32.

As illustrated, when a couch is formed by nesting the back and base frames, the distal and proximate armrest structures align so that the resulting upwardly and forward facing edges of the armrests 26, 28, e.g., armrest surfaces 52, 54 form a flush surface. One way to accomplish this flush surface configuration is to prop the back frame 12 on distal and proximate ledges 48, 50 which extend from respective distal and proximate ends 44, 46 of the base body panel 34. Each of the ledges 48, 50 has a thickness which is the same as the base body panel 34 and has a span in the widthwise direction for the couch 10 which is the same as the thickness of any of the armrest structures. The ledges 48, 50 are capable of being removed or pivoting away from the widthwise exterior of the couch 10 when forming a play space.

The back frame and base frame are sized so that the armrest structures are widthwise separated by a same dimension. Accordingly, to enable nesting, a lengthwise extending split 120 is provided in the widthwise center of the back frame so as to define distal and proximate back frame structures 43, 45. The back frame structures are connected with, for example, widthwise extending slots in the distal and proximate portions of the back body panel 24 and a common slider is widthwise connected therebetween. The type of slider would function similarly to slider 130, discussed in greater detail below, and illustrated in, for example, FIG. 9, to enable spacing the distal and proximate back frame members so as to enable nesting with the base frame.

Figure 1A:
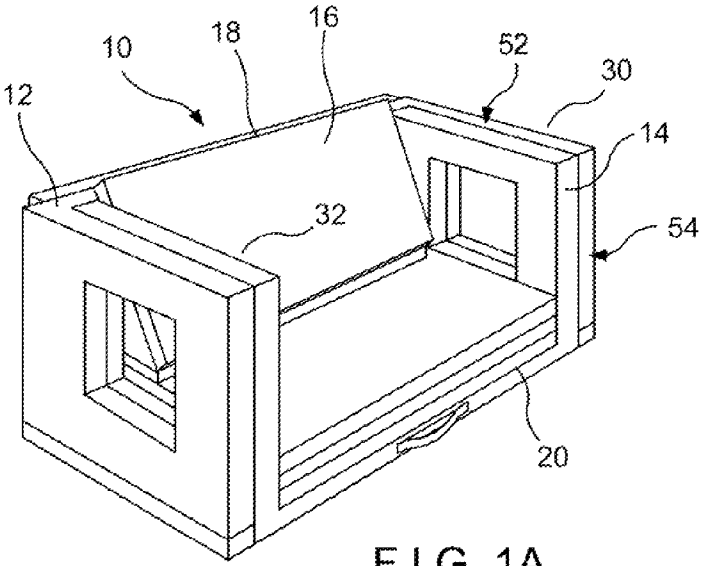
FIG. 1A is a view of the convertible furniture as a couch.

When the back frame 12 and base frame 14 are nested to form the couch 10, as illustrated in FIG. 1A, the base body panel 34 faces downwardly while the back body panel 24 faces rearwardly. In addition, when nested, with the distal armrests 26, 34 are positioned against each other and the proximate armrests 28, 36 are positioned against each other, and the back armrests 26, 28 rest on respective distal and proximate back frame ledges 48, 50.

Figure 3A:
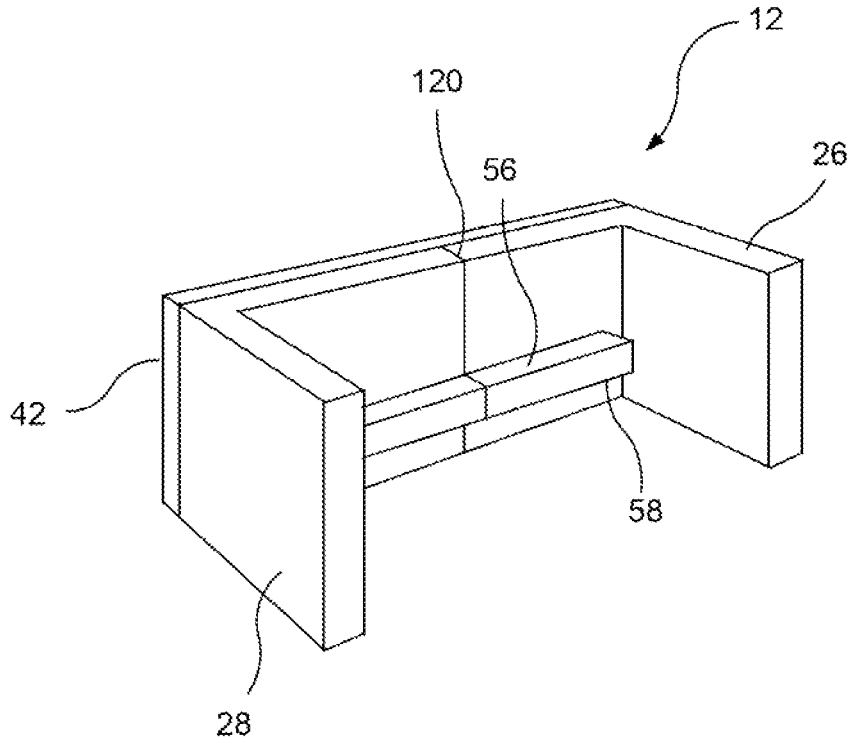
Figure 3B:
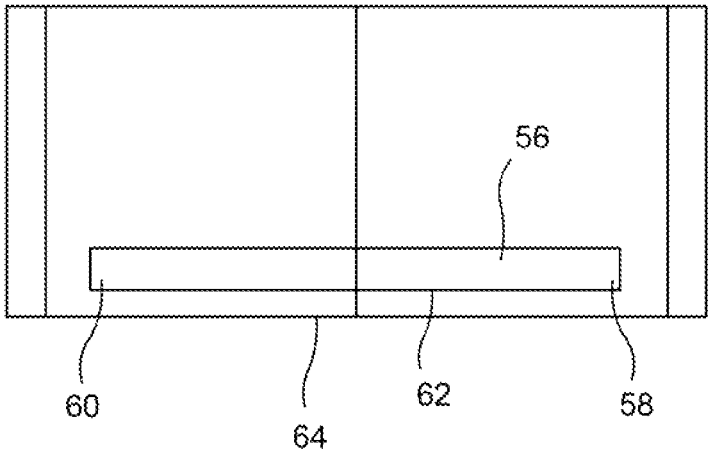

As illustrated in FIGS. 2 and 3A-3B, an internally facing back frame ledge 56 is provided, which extends between the armrests 26, 28. Distal and proximate ends 58, 60 of the back frame ledge 56 are spaced from the respective back frame armrests 26, 28 by a distance which allows the base armrests 36, 38 to fit therebetween when the couch 10 when assembled. In addition, a bottom facing edge 62 of the back frame ledge 56 is spaced from a bottom facing edge 64 of the back frame 12 by a distance which allows the base body panel 34 to fit thereunder when the base frame 14 and back frame 12 are nested to form the couch 10.

Figure 1C:
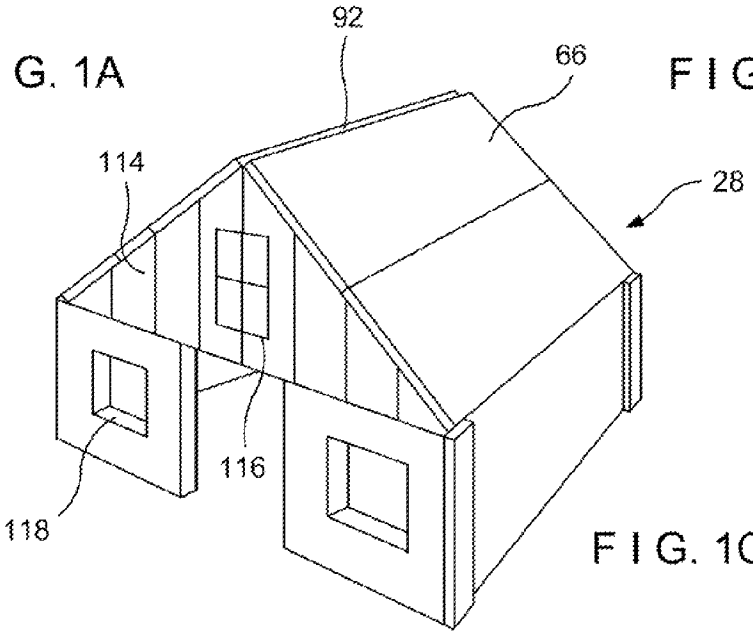
Figure 4:
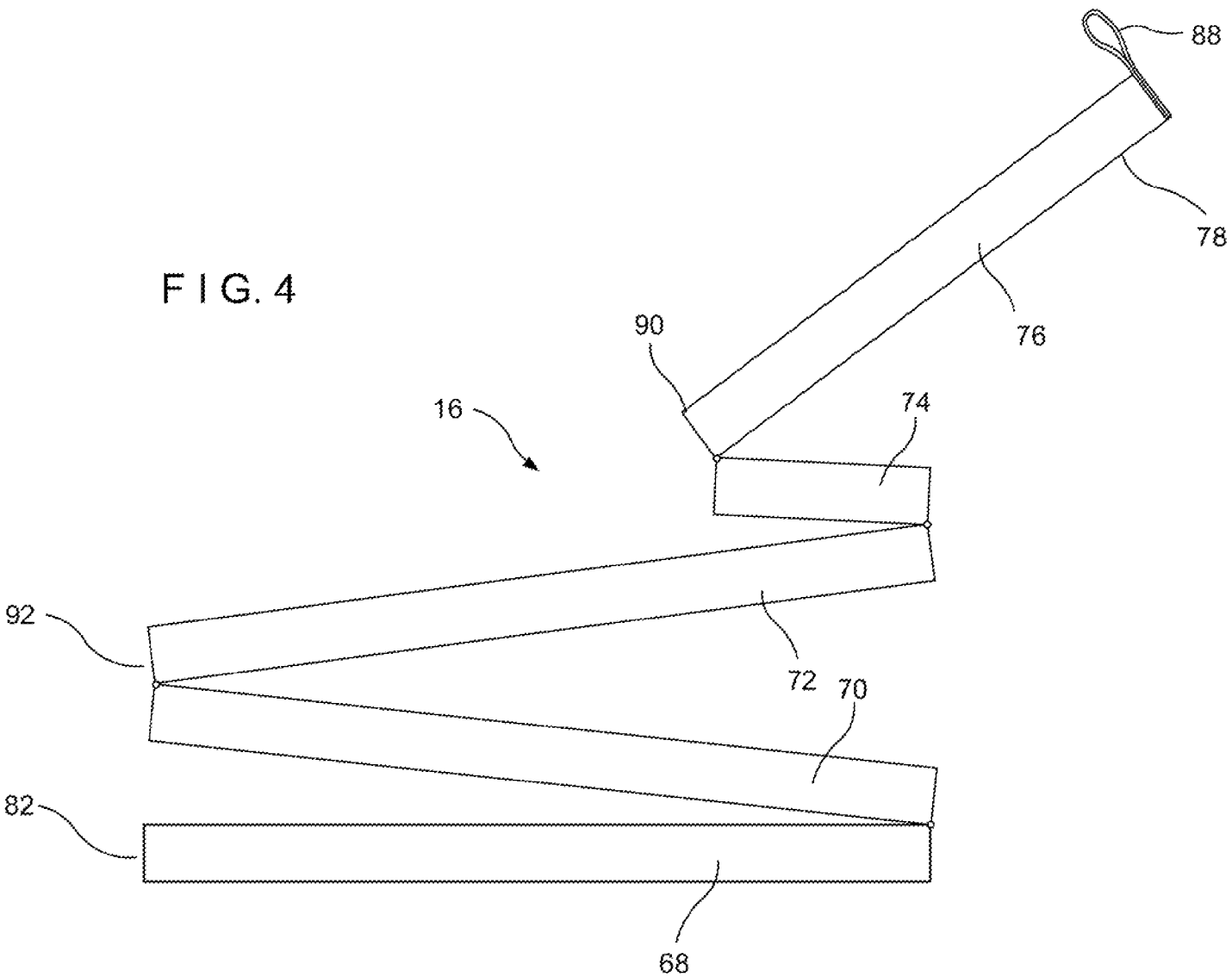
FIG. 4 illustrates couch cushions.

The couch cushions 16, as illustrated in FIG. 1C, form the roof 66 of the playhouse 22. As illustrated in FIG. 4, the cushions 16 include first 68, second 70 and third 72 cushions of equal size. In addition, fourth 74 and fifth cushions 76, together, are substantially the same size as any of the first three. The five cushions are pivotally connected, end to end, lengthwise across the couch 10, and each spans widthwise the full distance between the base armrests 34, 36. A back frame end 78 of the assembled cushions 16, is pivotally connected to an upwardly facing edge 80 of the back frame 12. On the other hand, a base-frame end 82 of the assembled cushions 16, is pivotally connected to a forwardly facing edge 84 of the base frame 14.

Figure 5:
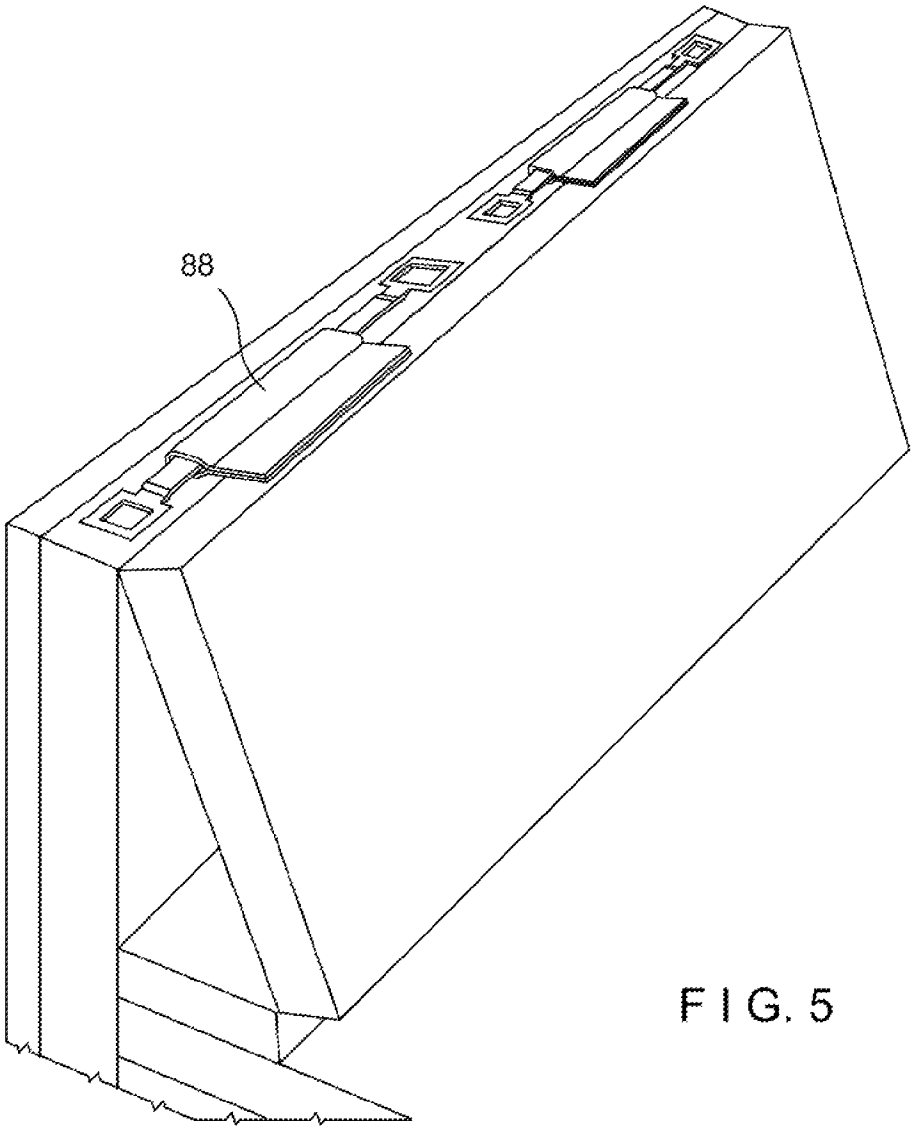
FIG. 5 illustrates couch cushions connected to the frame members.

The connection at these lengthwise ends is illustrated in FIG. 5. For example, a band 86 atop the back frame 12 of the couch attaches to a loop 88 on the free edge 78 of the cushion 16. The connection allows for widthwise spacing of the back frame 12 distal and proximate structures for nesting with the base frame. The same connection can be provided on the lengthwise opposing end of the cushion 16, or the base frame connection can be via traditional stitching which enables relative pivoting.

The length-wise span of the fourth cushion 74 is shorter than the fifth cushion 76, which is connected to the back frame 12. In the assembled couch, the fourth cushion spaces a bottom part 90 of the fifth cushion 76 away from the back panel 10 of the back frame 12. This angles the fifth cushion 76 in a comfortable lumbar supporting configuration for a child sitting on the assembled couch 10. This also enables the lengthwise end of the fifth cushion to sit flush with the top end of the back frame. However, if the cushions were made shorter, which would result in a roof having a smaller pitch, it is possible to provide a total of four cushions in the lengthwise direction in which the lengthwise end of the fourth cushion sits flush with the top end of the back frame. In such a configuration, however, the lumbar supporting angle would be omitted from the couch configuration.

To turn the couch into a house 22, the base frame 14 is pulled out and away from the back frame 12 and rotated so that its body member 34 is parallel with the back frame body member 24. In this configuration, the back frame and base frame form U-shapes, wherein legs of the U, formed by respective armrests, extend toward each other. The cushion set 16 unfolds as illustrated in FIG. 1B.

Figures 6A, 6B, 6C:
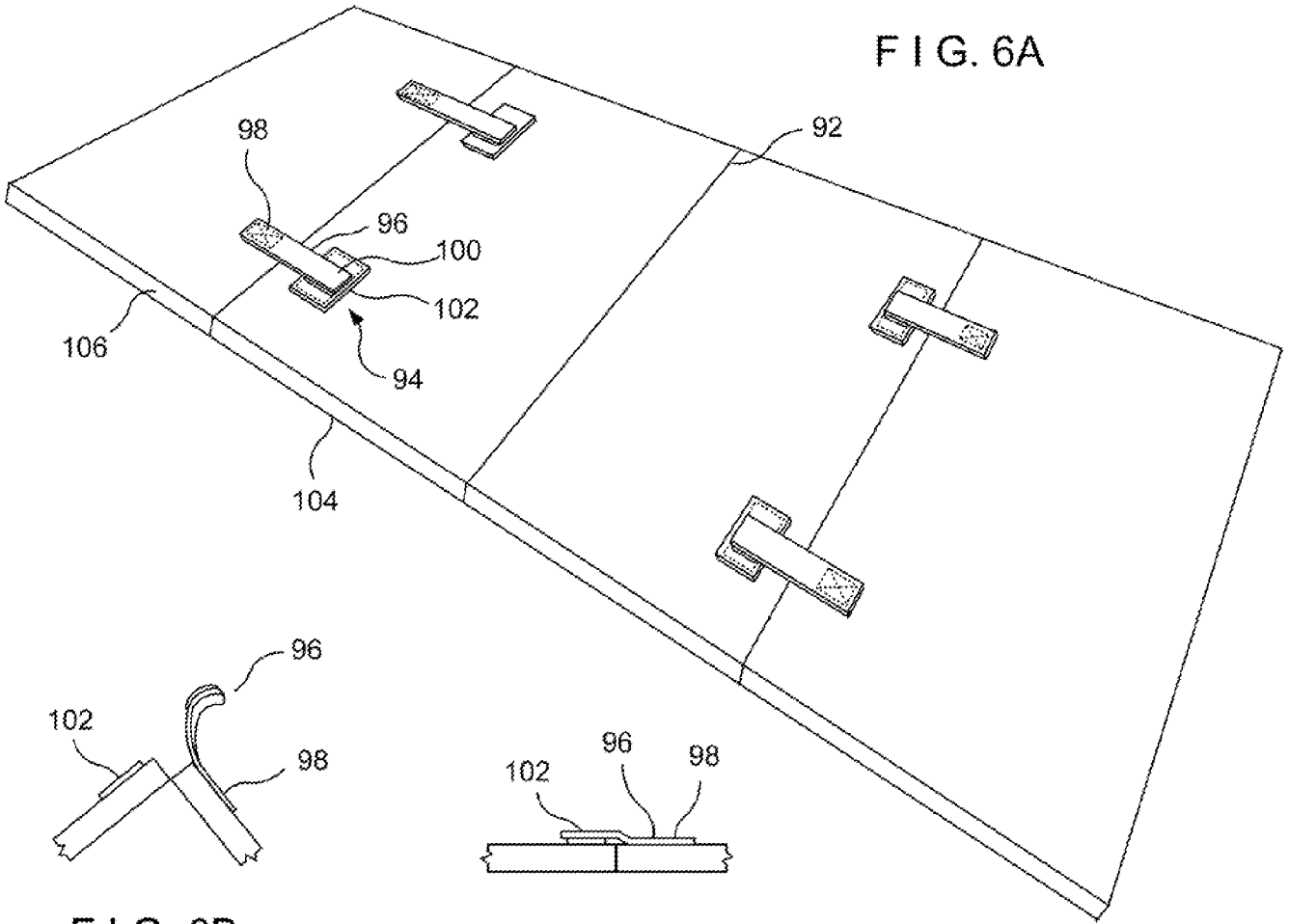
FIGS. 6A-6C and 7A-7C illustrate couch cushions being transformed into a gable roof.

The lengthwise center 92 of the cushions 16 forms the peak of the gable roof 66. Accordingly, when the roof is formed, the only desirable bend in the roof is between the second and third 70, 72 cushion members. To provide rigidity between the remaining cushion structures on either side of the gable peak 92, Velcro connectors, e.g., connector 94, extend across the pivotal connections for the other cushions as illustrated in FIGS. 6A-6C. It is to be appreciated that the laid-out configuration of the cushions in FIG. 6A is not reached when forming the house and when the gable end 114 (disclosed later) is fully connected. However providing a laid-out configuration is useful for understanding the operation of the Velcro connectors on either side of the roof peak 92.

Each Velcro connector, e.g., connector 94, includes a strip 96, one end 98 of which would be permanently adhered to one cushion, and another end 100 of which would removably connect to a receiving strip 102 on the adjacent cushion. When in a couch configuration, the connectors are not connected, as illustrated in FIG. 6B. However, when the cushions 16 are spread out to form the roof illustrated in FIG. 1C, the Velcro strips are connected as illustrated in FIG. 6C, the cushions on either side of the roof peak 92 function as unitary members. In this configuration, the gable roof illustrated in FIG. 1C is formed by lifting the peak 92 of the cushions while sliding the back and base frames towards each other.

Figure 7B:
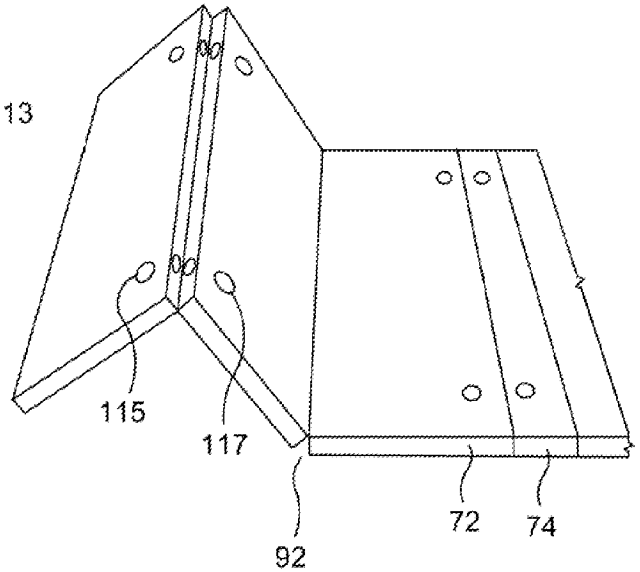
Figure 7A:
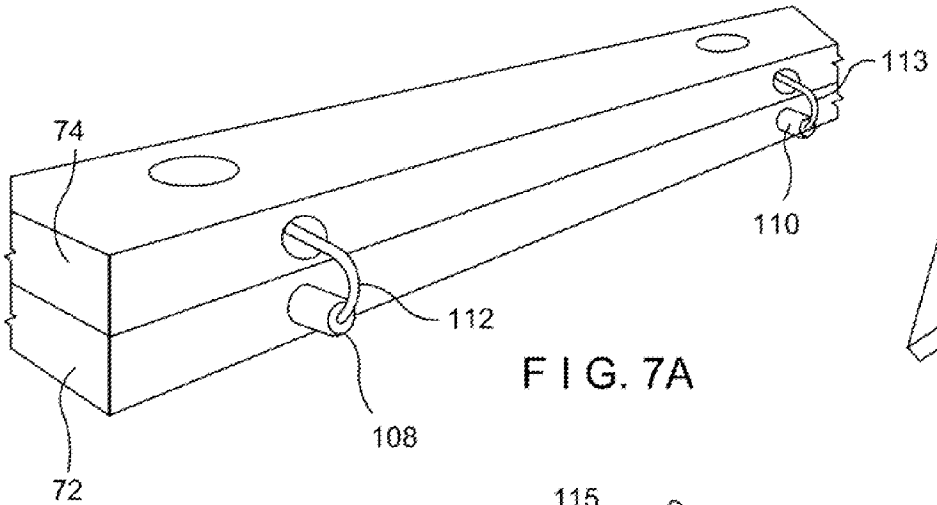
Figure 7C:
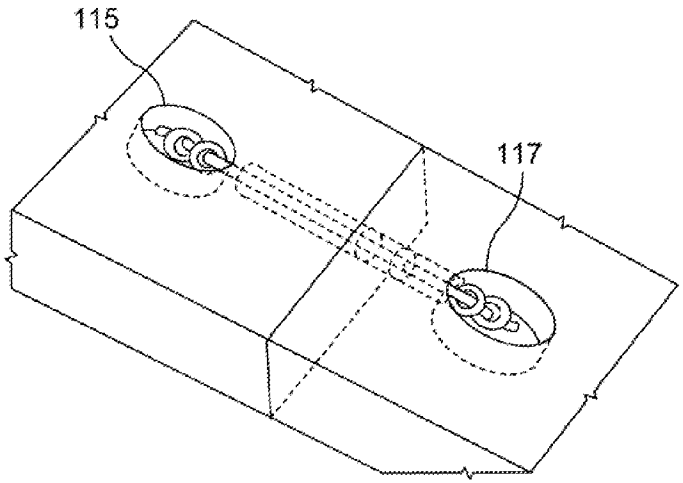

As illustrated in FIGS. 7A-7C (with the Velcro straps omitted for clarity), to provide additional structural support for the gable roof, along either side of the roof peak 92, the cushions 72, 74, are provided with through holes for receiving tent pole structures 108, 110, with elastic shock cords 112, 113 for connecting the cushions 72, 74. The tent pole structures 108, 110 have a diameter of approximately half the thickness of the cushion material so that the structures can be snug-fit within cushions through holes without compromising the feel of the cushions. Depressions 115, 117 at cushion side ends of the through holes provide access points for knotting the ends of the shock cord so as to keep the cord within the tent pole structures. This connection is similar to many quick-folding and self-erecting tents obtainable from stores selling outdoor and camping goods.

In addition, to help stabilize the structure, when in the couch configuration, couch stabilizing means can be provided. The couch stabilizing means includes, for example, distal and proximate rectangular members which extend through the windows openings in respective distal and proximate armrests when the back and base frames are nested, and the window openings themselves would be included as the vertical stabilizing means if not otherwise provided for.

Additionally or alternatively to the structure in the above paragraph, a removable member can be placed in the center opening of the back frame created when the back frame is separated for nesting with the base frame. This removable member could be T-shaped, with the long T member extending upwardly and the side T members extending underneath the bottom edge of the back frame. Additionally or alternatively, a latch could be attached between the adjacent armrest members to prevent relative motion. The latch could be anywhere about the armrests which is not readily visible. For example, connecting adjacent edges between the pair of distal and pair of proximate armrest structures, there could be snaps, zippers or Velcro strips such as disclosed in FIGS. 6A-6B between lengthwise adjacent cushion members or FIGS. 11A-11B between distal and proximate cushion segments. Additionally or alternatively, a removable fitted cover can slipped over the couch and which could. Velcro, snap or zipper in place.

Figure 8C:
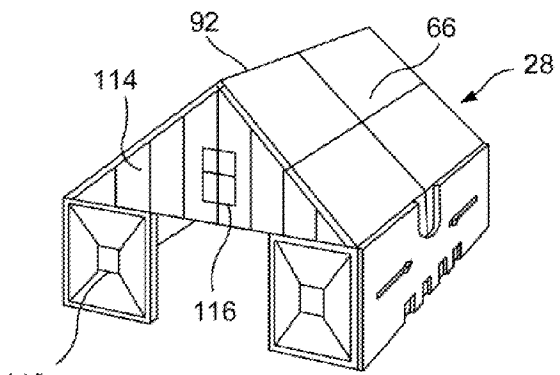
FIGS. 8A-8F illustrate the couch being transformed into a castle.
Figure 8B:
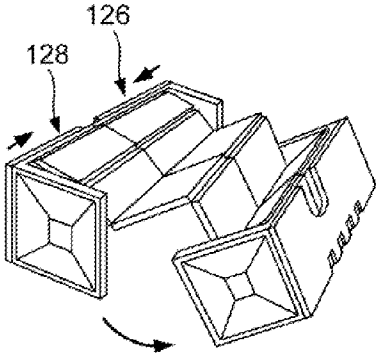
Figure 8A:
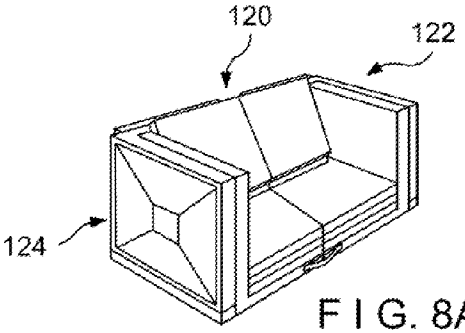
Figures 11A, 11B:
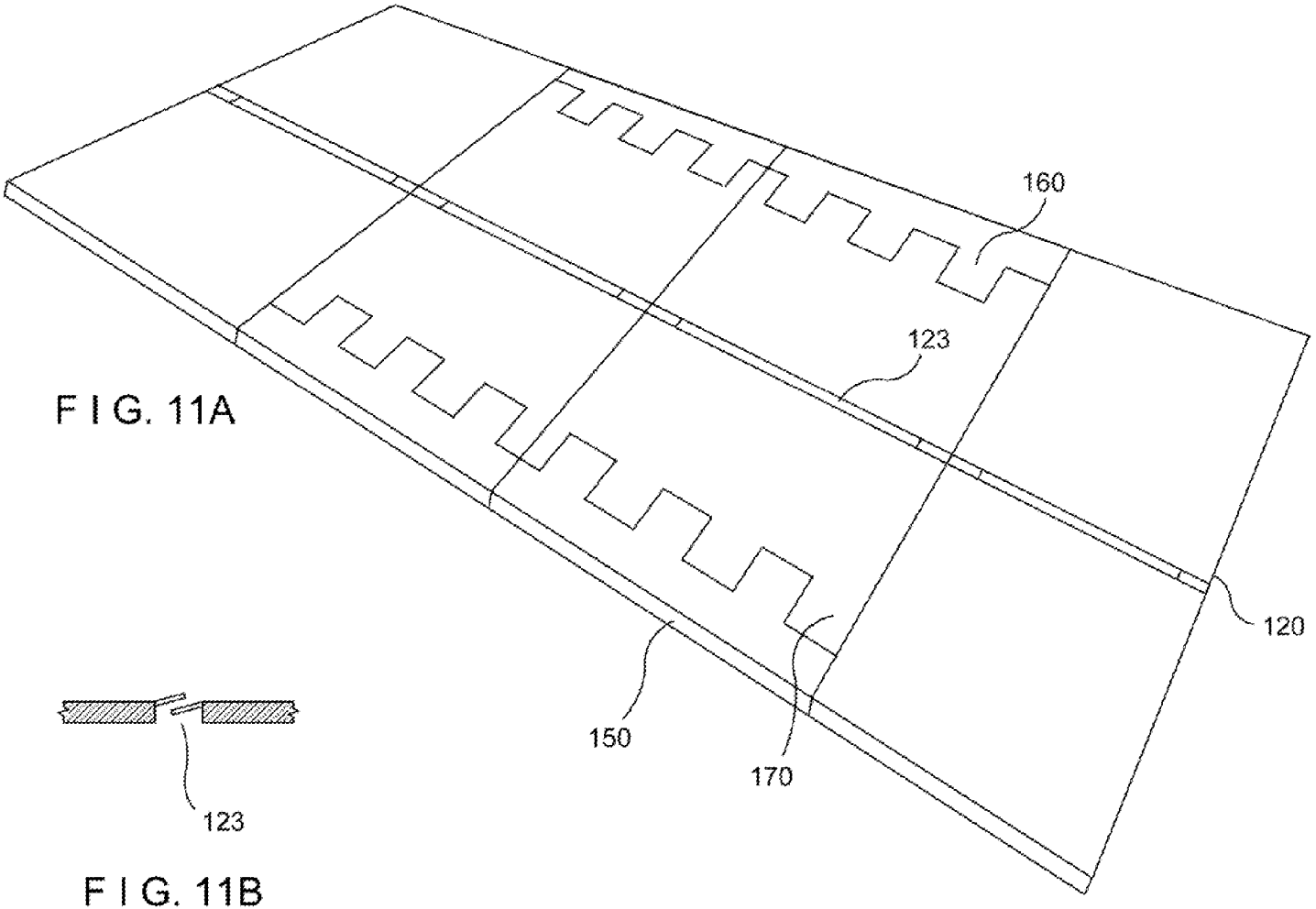
FIGS. 11A and 11B illustrates cushions utilized for transforming the couch into a castle.

In one embodiment, illustrated starting in FIG. 8A, the structure can be further transformed into a castle. As illustrated, the back frame, base frame and cushions have the same shape and connections as disclosed above, but all now include the widthwise central split 120, running in the lengthwise direction of the extended cushions, end to end on the couch 10 structure. The split 120 divides the couch structure into distal and proximate couch structures 122, 124. For various illustrations in this embodiment, the fourth and fifth cushion members are illustrated as a single member for brevity. In addition, as illustrated in FIGS. 11A-11B, the cushions include Velcro, zippers or snaps, e.g., Velcro connectors 123 for connecting distal to proximate sides of the cushion segments.

Figure 8D:
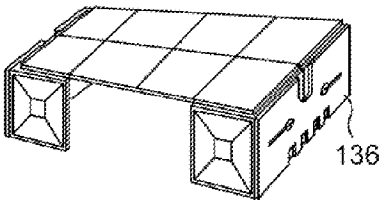

As the cushions extend to the configuration illustrated in FIG. 1C, the tent poles lock into place. If the gable end 114 was disconnected, then the cushions would become laid-out as illustrated in FIGS. 7 and 8D, and the lengthwise center 92 of the cushions 16 would be lifted so that the back frame 12 and base frame 14 would then moved towards each other. Either way, a 12:12 pitched gable roof for the house, e.g., a downward V shape of a house roof, is formed. Accordingly, it can be appreciated that transforming the couch into a house requires similar effort to unpacking a self-erecting tent.

A set of triangular gable end members, e.g., previously identified gable end member 114, are provided, which are pieces of decorated fabric that form the gable ends of the house. The gable ends can have windows 116 as illustrated. As illustrated, the space under the gable ends and between the couch armrests forms the entrance for the house. In addition, each of the armrests may be provided with a centrally deposed square cutout, e.g., cutout 118, serving as a window in the playhouse 22.

The gable ends 114 can attach via, e.g., zippers to the eves of the gable roof and can remain attached during transformation into a couch. This is because the gable ends consist of flexible fabric material and are not fortified with a cushion fill or other rigid material.

The zipper or similar connection enables partial or complete removal of the gable end fabric from at least one of the eves so as to enable transforming the couch further into a castle, as will be disclosed below. If a partial removal is desired, the gable ends can roll up or become otherwise connected to and/or tucked away on the cushion structure to which it remains connected.

It is to be appreciated that the gable end fabric 114, when it remains fully connected during the couch to house transformation, prevents the cushions from becoming completely laid-out as illustrated in FIG. 8D, which will be discussed later.

As indicated, the distal and proximate structures 126, 128 of the back frame member 12 are held together by a back frame sliding member 130. On the other hand, the distal and proximate structures 132, 134 of the base frame member 14 are held together by a base frame sliding member 136. The sliding members 130, 136 allow the distal and proximate couch structures 122, 124 to slide together for forming a couch or gable roof house and slide away from each other for forming a castle.

Figure 9:
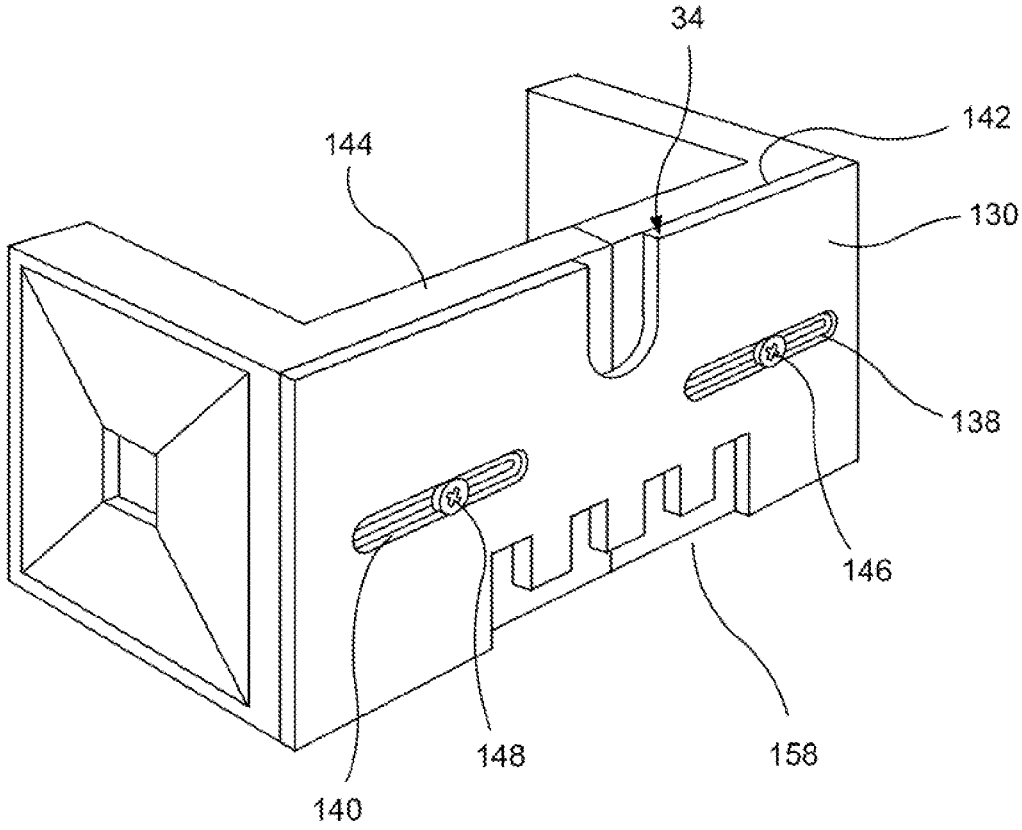
FIG. 9 illustrates a frame member used for the castle.

To provide the sliding function, the sliding members 130, 136 each include slots, e.g., slots 138, 140, illustrated in FIGS. 8D and 9. The distal and proximate portions of the divided body panels, e.g., distal and proximate portions 142, 144 of the base panel 34 in the base frame 12, include plastic bolts 146, 148 with receiving nuts or the like, which are child safe and which slidingly connect the distal and proximate couch structures 122, 124.

Turning the couch 10 into a castle, with the structure required therefore, will be further discussed with reference to the figures, starting with FIG. 8D, which illustrates the frames in a spaced apart configuration and the cushions in a laid-out configuration. As indicated above, if the gable ends, such as gable end 114, are fully connected, one must first form a house as with FIGS. 1A-1C and FIGS. 8A-8C, and detach at least one side of each of the gable ends of the house before continuing onto FIG. 8D. On the other hand, if at least one edge of each of the gable ends was previously disconnected then one could attempt to form a castle directly from the couch. The edges of the gable roof ends could have been previously disconnected if, for example, one previously transformed the castle directly to the couch. Under such circumstances, one could separate the frame members as illustrated in FIGS. 8A and 8B (for simplicity, drawn without slots 138, 140 and ramparts 160, introduced below and illustrated in, for example, FIGS. 10C and 11A) and advance directly to the configuration in FIG. 8D, without having to first form the house as illustrated in FIG. 8C.

Figure 8E:
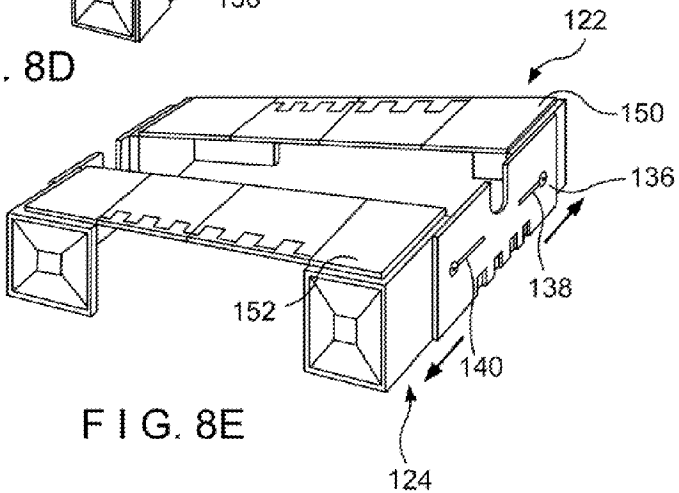

Accordingly, turning now to FIGS. 8D-8E (where 8E includes ramparts 160), with the cushions 16 in a flattened configuration, the back and the bottom frame members 10, 12 are pulled apart in the widthwise direction. This widthwise separation forms the distal and proximate couch structures 122, 124 connected by respective sliding members 130, 136.

Figure 8F:
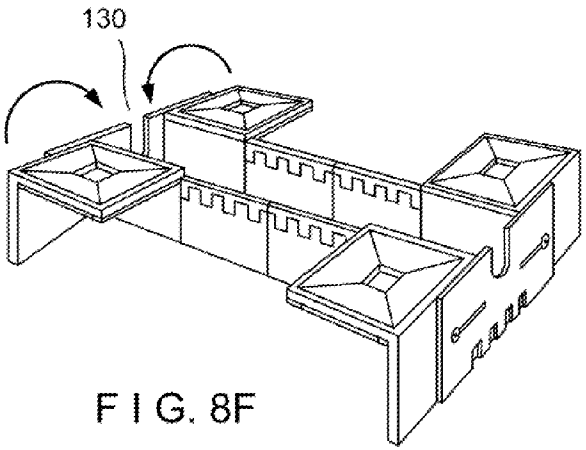

As illustrated in FIG. 8F, each of the couch structures 122, 124 is pivoted about respective sliding member connection points, e.g., points 146, 148, so that the square face of each of the armrests 26, 28, 36, 38 faces upwardly. In this configuration, the cushion panels 16, having been separated into distal and proximate segments 150, 152, are adjacent to each other, in the widthwise center of the structure, so that the top surfaces of the cushions face each other.

Figure 10B:
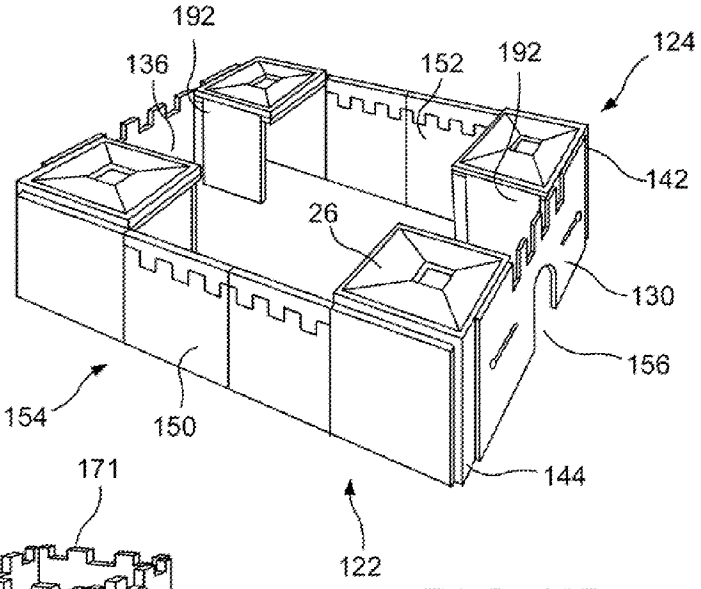
FIGS. 10A-10C continues to illustrate the couch being transformed into a castle.
Figure 10A:
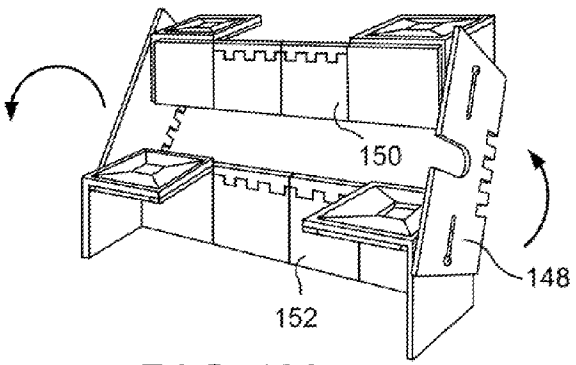

Once separated, as illustrated in FIG. 10A, one of the distal and proximate couch structures 122, 124 (either one) is pivoted about the connection point 146, 148 of the other of the couch structures 122, 124, about the respective sliding members 130, 136. As a result, the top surface of the cushions face away from and are spaced from each other. In this configuration, the distal and proximate cushion panels 150, 152 are on the widthwise exterior of the structure, i.e., on the outside of the castle structure. The exterior castle walls are formed by, e.g., the cushion panels 150, 152; the sliding members 130, 136; and the exposed portions of the distal and proximate structures of the back frame and base frame, i.e., panel parts 142, 144, extending from behind the respective sliding members 130, 136.

Forming entryways to the castle 154 are arched entrances, e.g., arched entrance 156 provided in the widthwise center of the respective sliding members 130, 136. The entrances, e.g., entrance 156, face downwardly at this point in the transformation process. However, the entrances face upwardly when provided in couch or house configuration. This is because flipping the distal and proximate couch structures 122, 124 about each other renders inverted the sliding members 130, 136.

As illustrated in FIGS. 9, 10B and 11, the widthwise exterior edges, e.g., edge 156, of the second and third cushions 70, 72 and the edges of the sliding members 130, 136 which face upwardly at this point in the transformation process, e.g., edge 158, are formed with crenellated ramparts. The crenellations are not utilized before this point and are ornamental in that they are only required for the ramparts.

The ramparts in the cushions 16 are formed by providing stepwise cuts in the cushion edges, e.g., edge 156. As seen when the castle is formed in FIG. 10C, the segment of the cushions which becomes extraneous when exposing the ramparts, e.g., segment 160, pivots away from the rest of the cushion structure 16. This can be accomplished via, for example, Velcro or other suitable sewn connection.

Further attention will now be provided to the armrests, where the discussion for armrest 26 applies equally to each armrest. The armrest 26 now face upwardly is transformed into a crenellated castle turret 161. As illustrated in FIG. 12, the square cutout 118 in the middle of the armrest 26, which formed a window in the house, is now provided with cut lines, e.g., cut lines 162, 164, which extend from each edge to an adjacent outside edge in the square armrest 26. The resulting structure for the armrest 26 comprises four trapezoidal turret panels, e.g., trapezoidal panel 166. While there are four trapezoidal panels in the turret 161, and sixteen for the castle, the discussion of trapezoidal panel 166 applies equally to each trapezoidal panel.

Figure 10C:
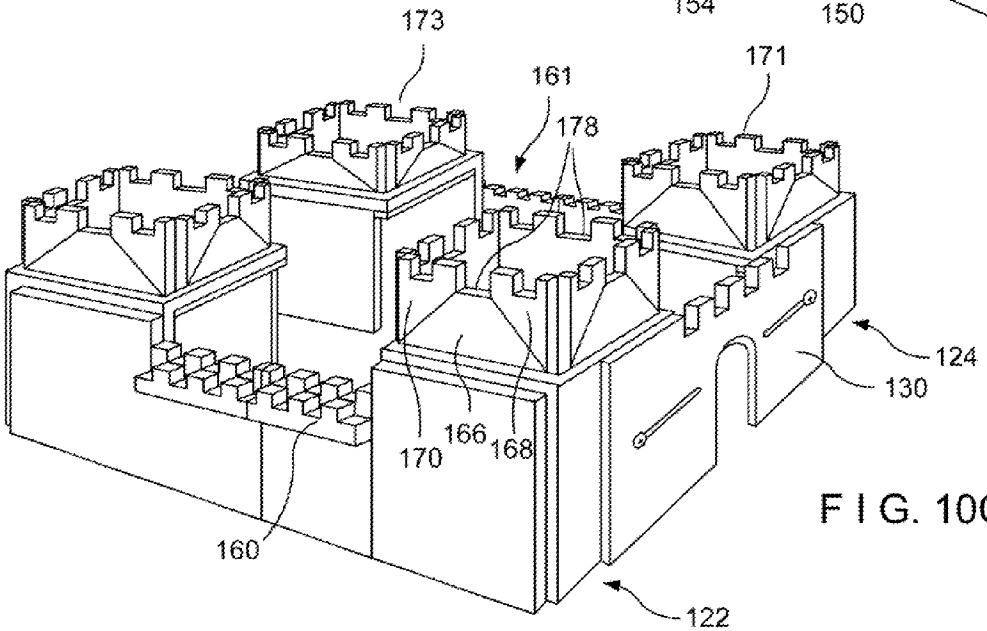

As illustrated in FIGS. 10C and 13, the trapezoidal turret panel 166 hinges outwardly and reveals a second layer of folded foam crenellated panels, e.g., panels 168, 170, for the trapezoidal panel 166. While there are four pair of crenellated panels for the turret 161, and sixteen for the castle, the discussion for the pair of crenellated panels 168, 170 applies to each pair. In addition, while there are eight crenellated panels per turret, and thirty two per castle, in each pair, the panels 168, 170 are essentially mirror images of each other. Accordingly, the individual discussion of crenellated panel 168 applies to all crenellated panels.

Figure 13B:
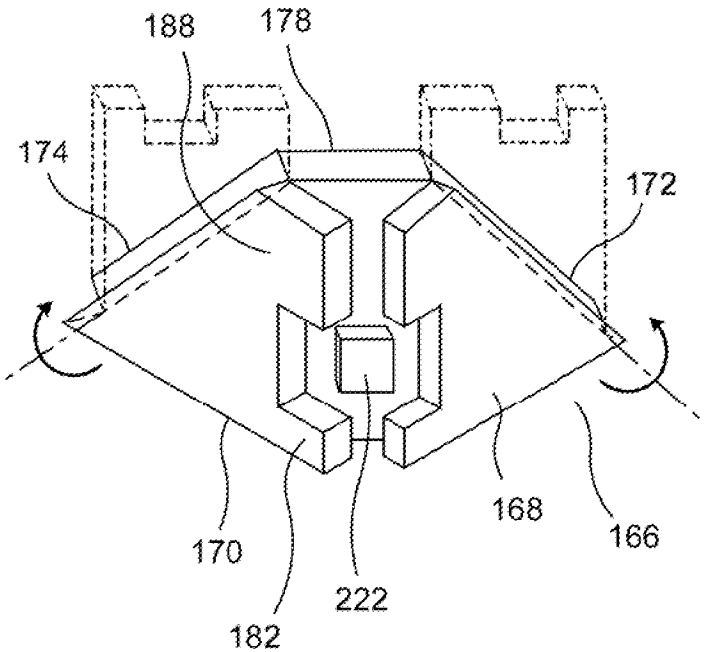
Figure 13A:
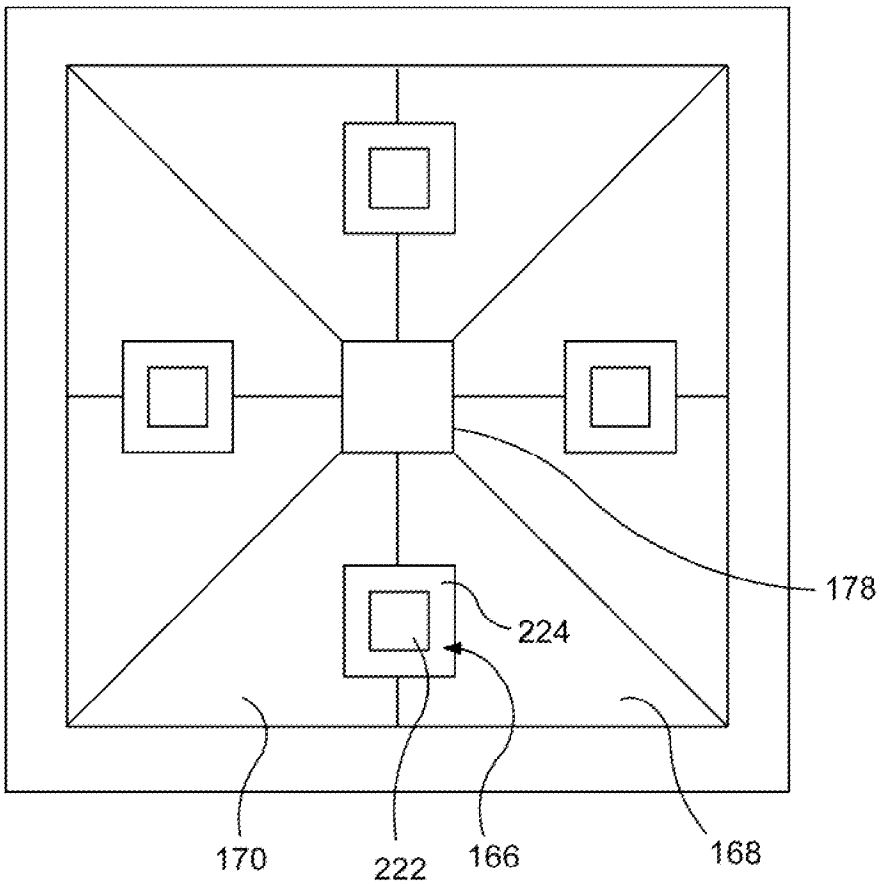

Turning back to the figures, as indicated, the pair of crenellated panels 168, 170 hinges upwardly, off the upwardly exposed and angled edges 172, 174 of the trapezoidal panel 166, to complete the crenellated parapet, e.g., enclosed balcony design, for the turret. Moreover, the shape of the crenellated panel 168 is essentially a right angle triangle which, when upwardly pivoted, terminates at an edge 176. Edge 176 is substantially level with the upwardly facing edge 178 the trapezoidal panel 166. As illustrated in FIGS. 9, 13A and 13B, two essentially square members 180, 182 extend upwardly from the edge 176 of the crenellated panel 168 to define the turret crenellations.

Figure 14A:
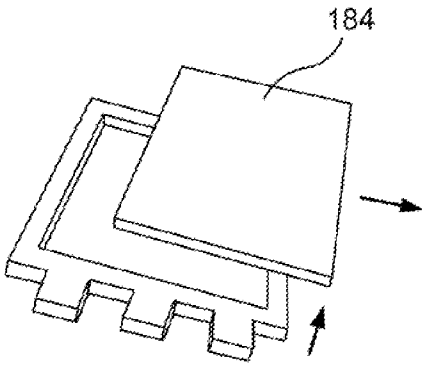
Figure 14B:
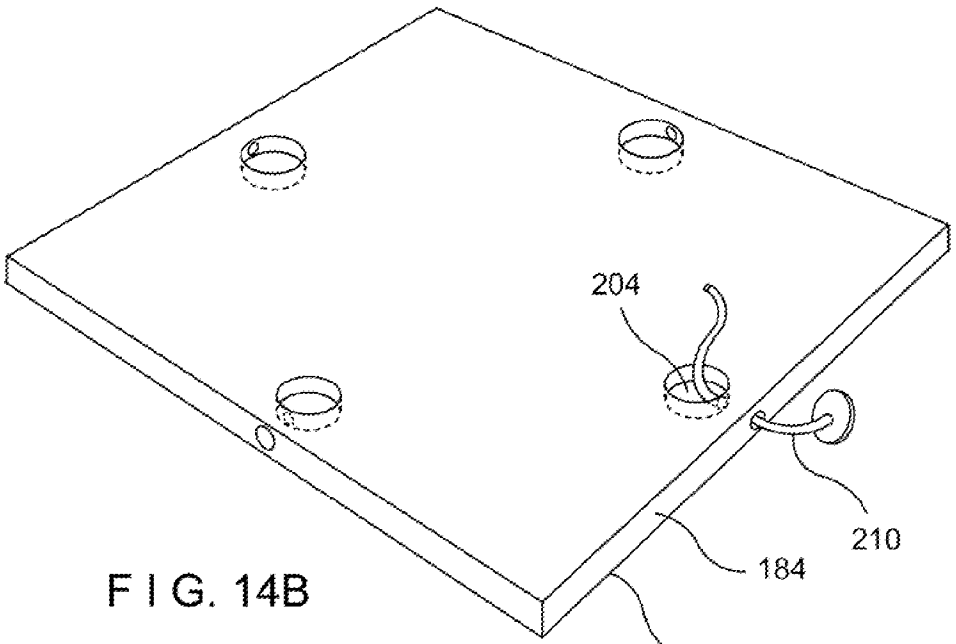

Turning to FIG. 14A, a foam horizontal (first) turret supporting panel, e.g., panel 184 is provided for the turret 161. There are four horizontal support panels in the castle, and the discussion for the supporting panel 184 applies equally to each. The horizontal support panel 161 is the same size as the turret opening when viewed from above. The horizontal turret support panel 184, when positioned at the top of the turret 161, at or below the upwardly facing edge 178 of the trapezoidal panel 166 enables the trapezoidal panel 166 and crenellated panels 168, 170 to maintain their upright positions when the castle 154 is formed. Removing the horizontal support panel 184 enables quick folding of the crenellated panels 168, 170 and turret 161, to the armrest 26 configuration for transforming the castle 154 back into a couch 10 or house 22. The horizontal support panel 184 can be kept in place using Velcro or snaps or other means which will be disclosed below.

Figure 15A:
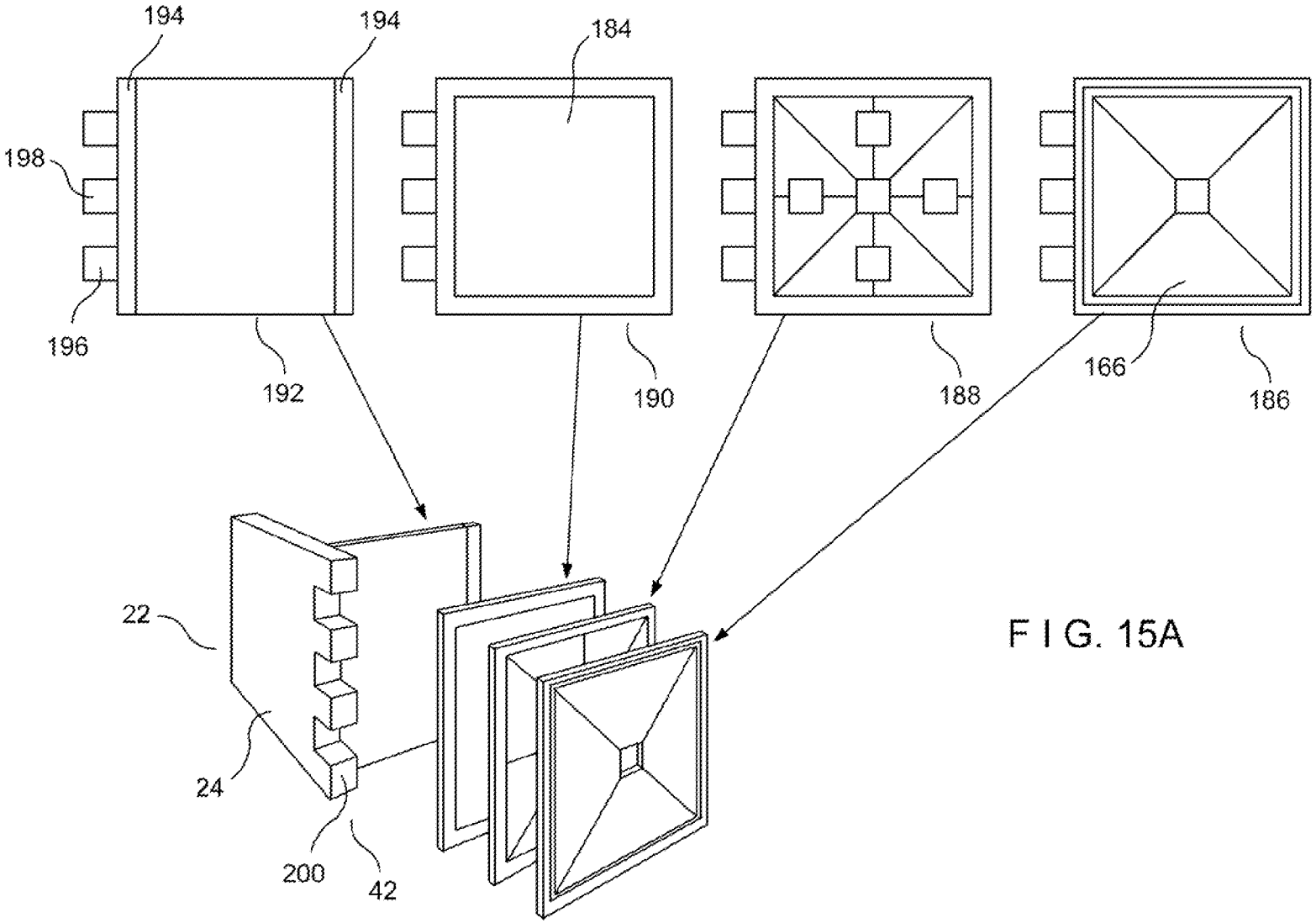
Figure 15C:
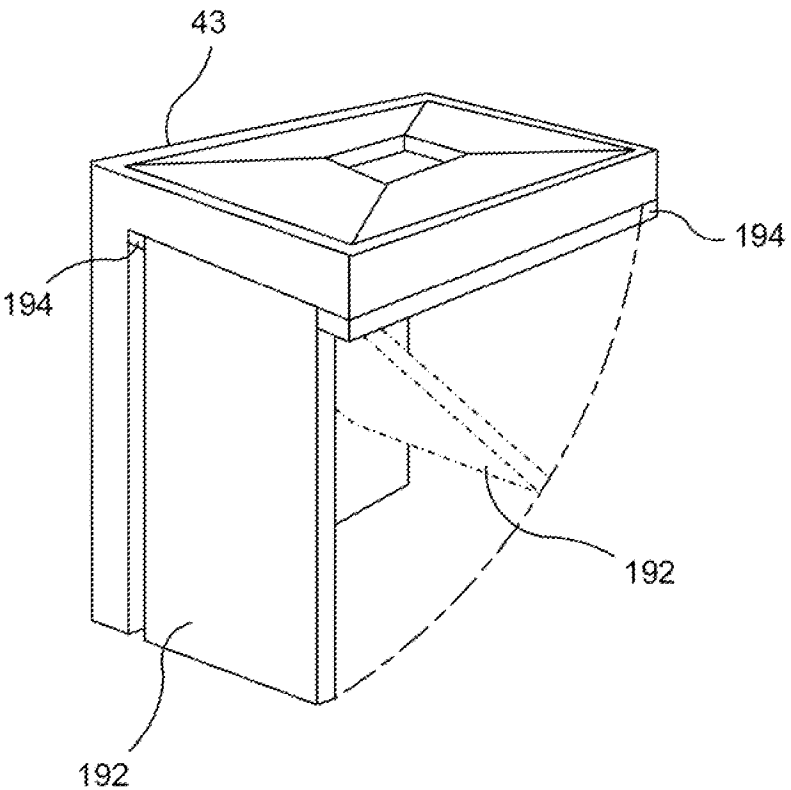
Figure 15B:
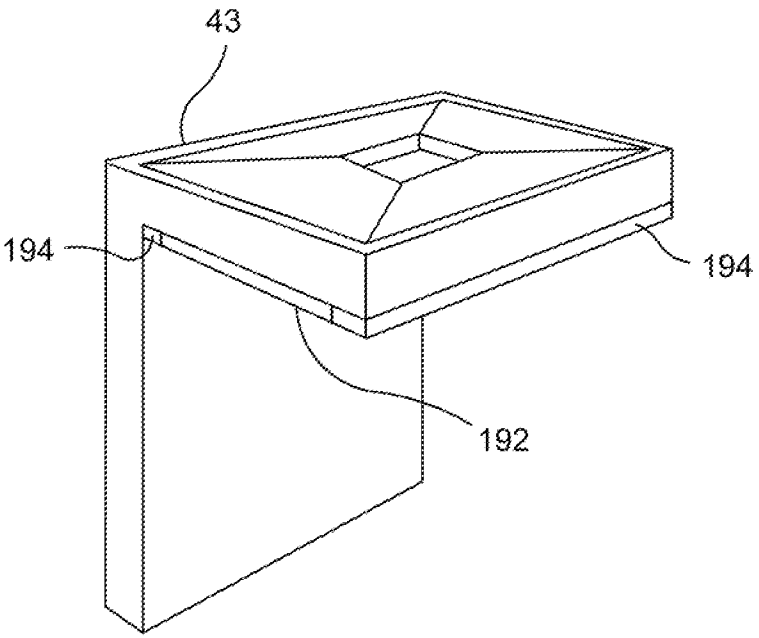

Turning to FIGS. 15A-15C, additional detail is provided regarding the construction of the armrests, as illustrated by armrest structure 26. The armrest 26 has four structural layers, which include respective boarder members. For example, the first layer includes the trapezoidal panels and a first boarder member 186; a second layer contains the eight crenellated panels and a second boarder member 188; a third layer contains the horizontal turret support panel and a third boarder member 190; and a fourth layer contains a vertical turret support panel 192, facing the widthwise internal side of the couch, and a boarder 194 for the vertical turret support panel.

As illustrated in FIGS. 10B and 15B-15C, the vertical support panel 192 is pivotally connected to its boarder 194. The vertical support panel 192 pivots downwardly so that it becomes parallel to but spaced from the cushion, but has an edge which is adjacent to, so as to brush against, the adjacently located frame member, to provide a third vertical support for its turret 161. Contact between the edge of the vertical support panel 192 and the frame member creates friction which provides stability to the vertical support panel when disposed in the vertical. The other two vertical supports include the back or base frame (depending on the turret) and the first or last (e.g., fifth) cushion panel segment (also depending on the turret).

The vertical support panel, to maintain its vertical orientation, includes vertical stabilizing means. The vertical stabilizing means can include a boss/dowel pin in the vertical support member which feeds into a curved groove/slot in the adjacent frame member. Or, for example, a flap could be provided in the frame member which pivots to an opened position when the vertical support member is vertically oriented. Another example would be snaps, zippers or Velcro at the vertical bottom of the frame member, at the location where the vertical support member is positioned at its maximum downward pivot location.

Figure 12B:
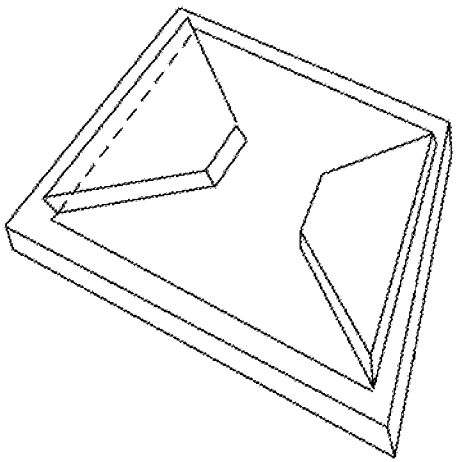
FIGS. 12A-12B, 13A-13B, 14A-14C, 15A-15C, 16A-16D and 17 illustrate an armrest structure utilized for transforming the couch into a castle.
Figure 12A:
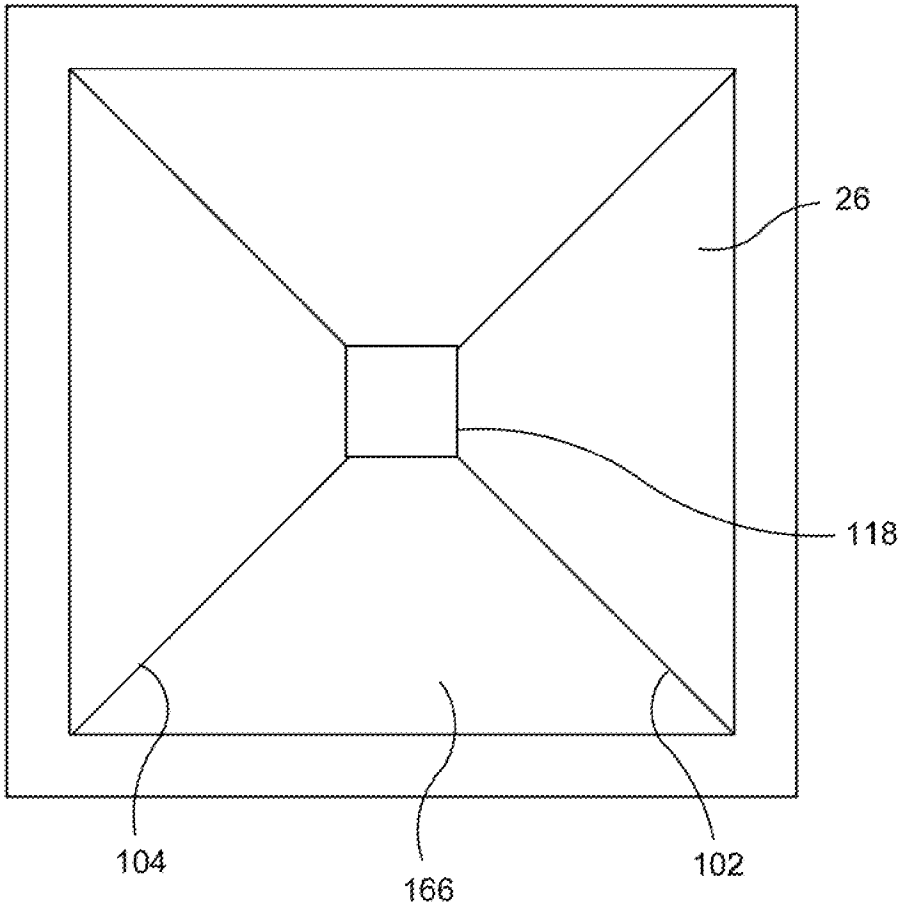

The trapezoidal panel 166 is pivotally connected to the edge of the second boarder 188 as illustrated in FIGS. 12B and 12C, so as to pivot upwardly from that boarder. The first boarder 184 has an internal perimeter which is sized to enable the trapezoidal panel 166 to sit on the edge of the second boarder 184 when vertically oriented. Accordingly, the primary purpose of the first boarder 186 is for squaring the widthwise outer structure of the armrest 26. The crenellated panels 168, 170 are connected to the trapezoidal panel 166 and not the second boarder 188. In addition, the horizontal supporting panel 184 is not connected to the third boarder 190. Both boarders 188, 190 serve the function of structurally squaring and supporting to the armrests 26.

The four boarders in the armrest 26 are interconnected via, e.g., glue or otherwise, to provide additional stability to the armrests. This is pertinent as opposing sides of the fourth boarder 194, flanking the vertical support panel 192, are not interconnected. That is, the vertical support panel 192 extends along the full span of the fourth boarder 194 so as to have enough length to level the turret 161.

In addition, each of the boarders can be dovetailed into respective distal and proximate ends of the body panels of the base and back frame members. FIG. 15A illustrates dovetail crenellations, e.g., crenellations 196, 198 in the boarder and crenellations in the panel 24, which are not to be confused with upwardly exposed castle crenellations. For example the dovetail crenellations 196, 198 serve a structural purpose while the exposed castle crenellations are ornamental. As an option, the boarder structures can be molded as a unitary member rather than as four separate layers and can also be molded as a unitary member with the widthwise ends of the respective frame members, depending on manufacturing requirements.

It is to be appreciated that if the house were to utilize a window opening provided in the couch arms, then the opening would have to be provided in each layer of the couch arm, including the horizontal turret support panel 184 and the vertical turret support panel 192.

The additional means will be disclosed for securing each horizontal support panel to each trapezoidal panel in each respective turret around the castle, as illustrated in FIG. 14A. As before, the discussion of the trapezoidal panel 166 and horizontal support panel 184 within the turret 161 is considered typical.

The underside of the horizontal support panel 184, the side facing the cushion 16, has four edges, e.g., edge 206. Typical with each edge, edge 206 has an impression, or blind hole 204, adjacent to it for receiving a knotted end 208 of a respective length of shock cord 210. The shock cord 210 is fed through a bore hole 212 leading out of the side edge 206 of the horizontal support panel 184. The shock cord 210 is then fed to the trapezoidal panel 166, which has a slot 214 extending in the vertical direction when the trapezoidal panel 166 is so oriented. The slot 214 terminates at a lower vertical end 216 with a first depression, and at a higher vertical end 218 with a second depression, each accommodating a button 220 tied to the shock cord 210.

Figure 14C:
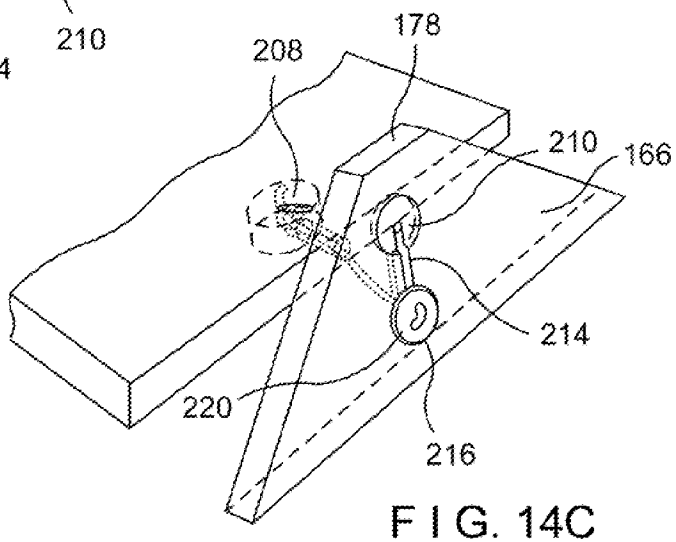

FIG. 14C illustrates that when the horizontal support panel 184 is raised to its topmost position, which raises and supports the turret 161, the button 220 is raised to the top depression. On the other hand, when the horizontal support panel 184 is lowered for collapsing the turret 161, the button 220 is lowered to the bottom depression.

Enough slack is provided in the shock cord 210 so that when the horizontal turret supporting panel is lifted, while the trapezoidal panel 166 is raised, the button 220 in the trapezoidal panel 166 can be lifted to the topmost button depression 218. On the other hand, when the trapezoidal panel 166 is lowered, the button 220 in the trapezoidal panel 166 can be lowered to the bottommost button depression 216.

Figure 16C:
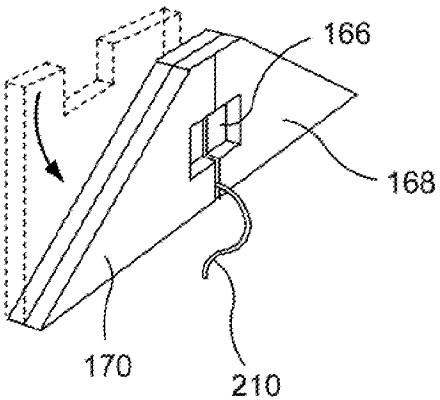
Figure 16D:
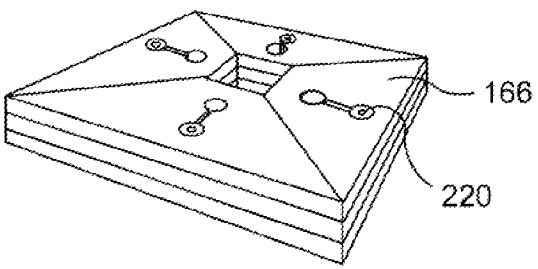
Figure 16A:
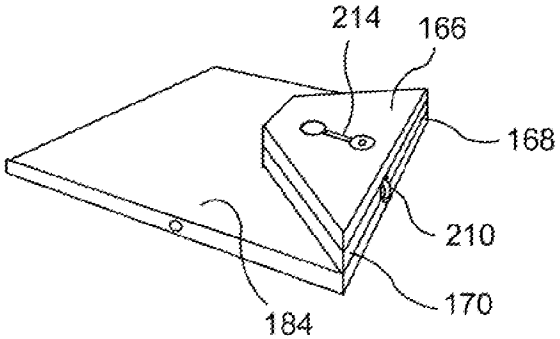
Figure 16B:
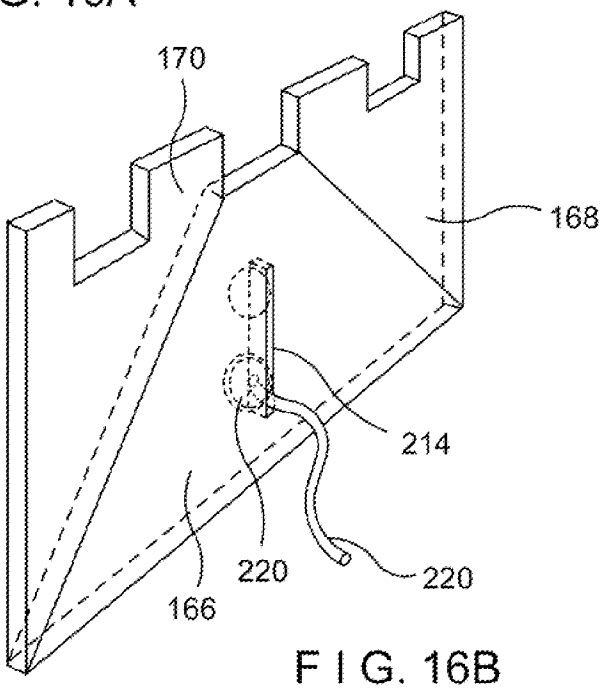
Figure 17:
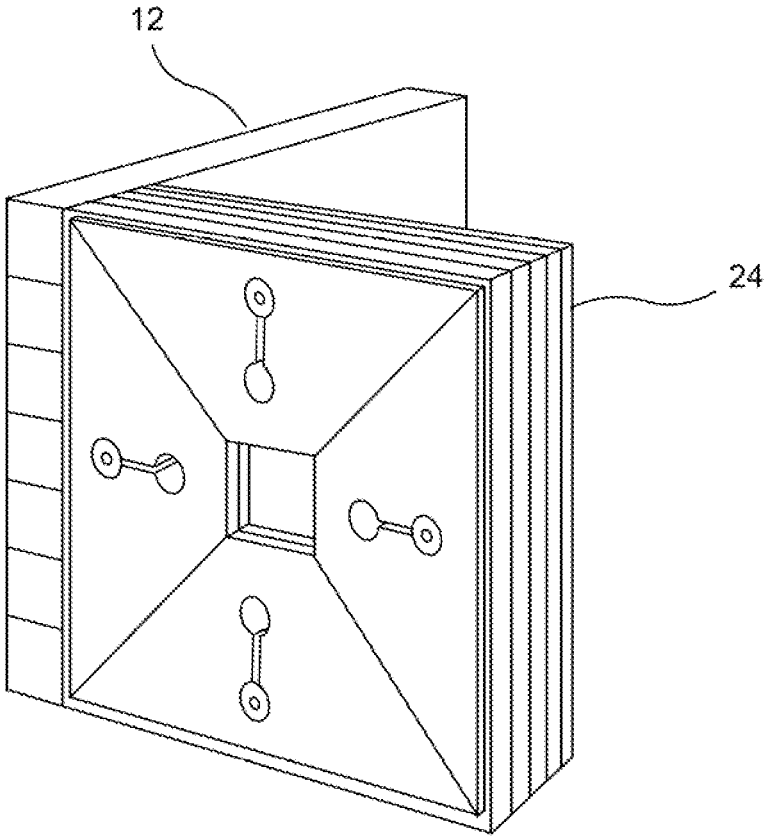

FIGS. 16A-16D further illustrate the appearance of the shock cord through the trapezoidal panel 166 before and after the folding of the crenellated panels 168, 170. The shock cord 210 is visible in the outside edge of the horizontal support panel 184 but then snakes between internally facing edges 226, 228 for the crenellated panels 168, 170 and into the slot 214 in the trapezoidal panel 166. FIGS. 16D and 17 provide a close-up of the armrest 26 with this structural configuration applied on each side of the support panel 184, and through each trapezoidal panel in the turret 161. The boarder structures are omitted from FIG. 16D and included in FIG. 17.

In an alternative embodiment, the horizontal support panel 184 is not connected by a shock cord but is removable from the castle turret. Each trapezoidal panel could include a cube-like ledge, e.g., ledge 222 on trapezoidal panel 166 in FIGS. 13A and 13B. The ledge 222 provides a downward translating barrier for the floating horizontal support panel 184. The ledge 222 is designed to fit within an opening, e.g., opening 224 defined by the crenellated panels 168, 170 folded against the trapezoidal panel 166. In this location, the existence of the ledge 222 does not prevent the crenellated panels 168, 170 from folding flatly away.

It is to be appreciated that the structure in the above disclosure may need to be slightly modified depending on manufacturing and structural constraints. Such modifications may not be fully fleshed out in the figures but are within the level of the ordinary skill upon reading this disclosure. For example, the fourth layer of material in each armrest may need notching to extend so as to not hit the back frame ledge when extended. In addition, the size of some or all of the cushions, in the lengthwise direction for the extended cushion set, may need some adjusting to account for proper folding in view of the same ledge in the back frame.

The invention is not limited by the above disclosure, or the appended claims, which are merely directed to illustrated examples.

I claim:

1. Transformable furniture, comprising a unitary structure wherein component pieces are permanently attached to each other; such that the component pieces are unable to be removed from the unitary structure; and wherein the pieces are transformable between a seating and a play space; the play space which includes at least one of a gable roof playhouse and a castle; and wherein first and second frame members are connected by cushion members, wherein the frame members move towards each other to form a couch and away from each other to form the play space; and wherein the first frame member is a back frame, facing a back side of the couch, and the second frame member is a base frame, facing a bottom side of the couch; and wherein the back frame includes a first distal side armrest structure and a first proximate side armrest structure and the base frame includes a second distal side armrest structure and a second proximate side armrest structure, such that when said back frame and base frame are moved towards each other, the first and second distal armrest structures and proximate armrest structures form a distal armrest and a proximate armrest for the couch.

2. The furniture of claim 1, wherein the play space is a gable roofed house and the furniture further includes triangular gable ends connected to the cushions so as to be positionable under the gable roof.

3. The furniture of claim 2, wherein a playhouse entryway is formed between spaced armrest structures and the gable ends.

4. The furniture of claim 2, wherein the armrests include central openings forming windows for the playhouse.

5. The furniture of claim 1, where the back frame and base frame, when moved away from each other, are widthwise separable, resulting in distal and proximate couch structures which are mutually pivotable about a connecting member so as to position the armrest structures in an upward configuration and to swap locations for the proximate and distal structures so as to form a play space.

6. The furniture of claim 5, where the armrest structures comprise a top layer including four substantially trapezoidal panels which pivot upwardly when forming the play space.

7. The furniture of claim 5, wherein the connecting member is crenellated.

8. The furniture of claim 5, wherein the connecting member includes an entryway.

9. The furniture of claim 5, wherein the connecting member includes slots and a child-safe connection between the slots and respective frame members.

10. The furniture of claim 6, wherein the play space is a castle and the armrest structures include a second layer which comprises two panels connected to each of the trapezoidal panels which pivot upwardly to form a turret when forming the castle.

11. The furniture of claim 10, wherein each pair of two panels which pivot upwardly to form the turret are crenellated.

12. The furniture of claim 10, wherein the armrest structures include a third layer which is a first support panel which translates toward a first layer to secure in an opened configuration each of the trapezoidal panels along with the upwardly pivoted two panels connected thereto.

13. The furniture of claim 12, wherein the armrest structures include a fourth layer which pivots downwardly to vertically support the turret.

14. The furniture of claim 12, wherein the first support panel is connected through each side edge to respective trapezoidal panels via biasing structure to maintain a relative position between the first support panel and the trapezoidal panels when the trapezoidal panels are raised.

15. The furniture of claim 12, wherein the first support panel is supported by ledges on the trapezoidal panels to maintain a relative position between the first support panel and the trapezoidal panels when the trapezoidal panels are raised.

16. The furniture of claim 13, including a vertical stabilizer for stabilizing the fourth layer in the downward position.

17. The furniture of claim 13, comprising one or more boarder layers respectively disposed about the four armrest structure layers for forming an outside structure of the armrest structures.

18. The furniture of claim 14, wherein the biasing structure is shock cord.

19. The furniture of claim 16, where the vertical stabilizer for the fourth layer includes one or more of snaps, zippers, hook and loop fasteners, and dowel pin and matching slot, connecting an edge of the fourth layer to an adjacent frame member surface.

20. The furniture of claim 17, wherein the boarder layers are dovetailed into respective frame members.

21. The furniture of claim 1, including a couch stabilizer for preventing relative movement of the couch when the back frame is nested with the base frame.

22. The furniture of claim 21, where the couch stabilizer for preventing relative movement between couch frames includes one or more of hook and loop fasteners, snaps or zippers connecting adjacent edges in the pair of distal armrest structures and adjacent edges in the pair of proximate armrest structures.

23. Transformable furniture, comprising at least a first frame member permanently connected to one or more permanently connected cushion members, which forms a couch when the cushions are folded and which unfolds into a play space, wherein said play space is a house with a gable roof; and wherein a lengthwise center of the cushions form a triangular peak of the gable roof; and wherein ends of the triangular peak of the gable roof connect to the cushions so as to be positionable under the gable roof.

24. The furniture of claim 23, formed from a unitary structure which transforms from the couch into the play space.

25. The furniture of claim 23, where the first and second members, when moved away from each other, are widthwise separable, resulting in distal and proximate couch structures which are mutually pivotable to form the play space.

26. The furniture of claim 25, where the play space is a castle with four corner turrets.

* * * * *